US005307962A

United States Patent [19]

Lin

[11] Patent Number: 5,307,962

[45] Date of Patent: May 3, 1994

[54] CONTAINER MOUNTED PUMP WITH IMPROVED CHECK VALVE STRUCTURE

[76] Inventor: Hui-Yu Lin, No. 85, Long Ho St., Taipei, Taiwan

[21] Appl. No.: 56,666

[22] Filed: May 3, 1993

[51] Int. Cl.[5] ..... B65D 88/54

[52] U.S. Cl. ..... 222/321; 222/380

[58] Field of Search ..... 222/321, 383, 385, 380; 239/333

[56] References Cited

U.S. PATENT DOCUMENTS 2,906,300 9/1959 Becher ..... 222/321 X 4,050,860 9/1977 Beres ..... 222/385 X 4,856,677 8/1989 Brunet et al. ..... 222/321 X

*Primary Examiner*—Gregory L. Huson

*Attorney, Agent, or Firm*—W. Wayne Liauh

[57] ABSTRACT

An improved pump-head structure, which has a valve annulus mounted on the inlet to the lower end of a liquid accumulator of the pump-head structure to prevent leakage of a liquid from the liquid accumulator. A plunger valve is connected to the valve annulus via a spring piece, which exerts a downward force on the plunger valve and thus maintains the inlet of the lower end of the liquid accumulator forcedly and tightly closed under normal conditions by the downward action of the plunger valve.

4 Claims, 4 Drawing Sheets

CONTAINER MOUNTED PUMP WITH IMPROVED CHECK VALVE STRUCTURE

BACKGROUND OF THE INVENTION

Generally, a liquid pumping head has widely been used for dispensing a liquid or a cream out of a container (such as a bottle or a can, etc.). The conventional pumping head as shown in FIG. 1 comprises a container cap "A" fixed onto a container for liquid; when the nozzle head "B" is pushed down and released, the piston "C" will pump the liquid in the container up. As soon as the piston "C" is pushed down, the spring "D" will be pressed downward to produce a dynamic force. As soon as the nozzel head "B" is released, the spring "D" will push the piston "C" upward to pump a liquid in the container up and into the liquid accumulator "F" through a delivery tube E; when the nozzle head "B" is pushed down again, the liquid pressure in the liquid accumulator "F" will cause the ball valve "G" to close the inlet of the accumulator, and to force the liquid to flow upward and out of the nozzle head "B".

Generally, the aforesaid ball valve "G" is made of plastics, or metal, or other plastic materials to provide a check function; since most of the liquids are viscous products (such as creams, shampoos or detergents), such liquids tends to form a coating layer on the ball valve "G" upon flowing through the valve when this occurs, after the ball valve "G" is fallen upon the inlet of the liquid accumulator "F", the inlet would not be closed completely as a result of an insufficient pressure of the ball valve "G"; in that case, the liquid in the liquid accumulator "F", if not being exhausted, would leak into the container. After a period of time, the nozzle head "B" would have more less difficulty to pump out the liquid, unless the nozzle head is compressed several times, and that would cause an inconvenience to a user.

BRIEF DESCRIPTION OF THE DRAWINGS

FIG. 3-1 and 3-2 are two sectional view of the present invention, showing the different pumping conditions of the pump.

DETAILED DESCRIPTION

Figure 2:
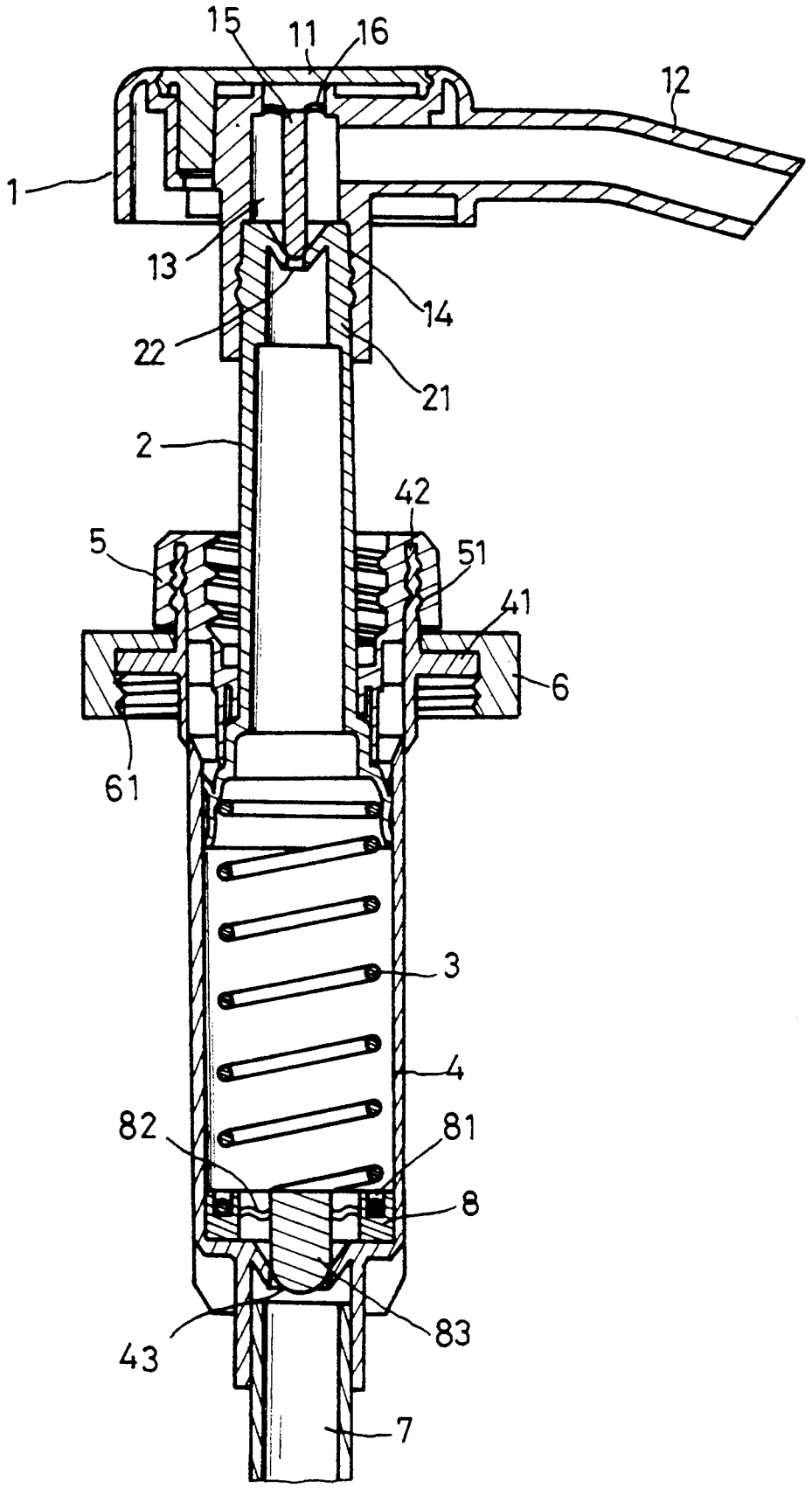
FIG. 2 is a sectional view of an embodiment according to the present invention.
Figures 1, 3:
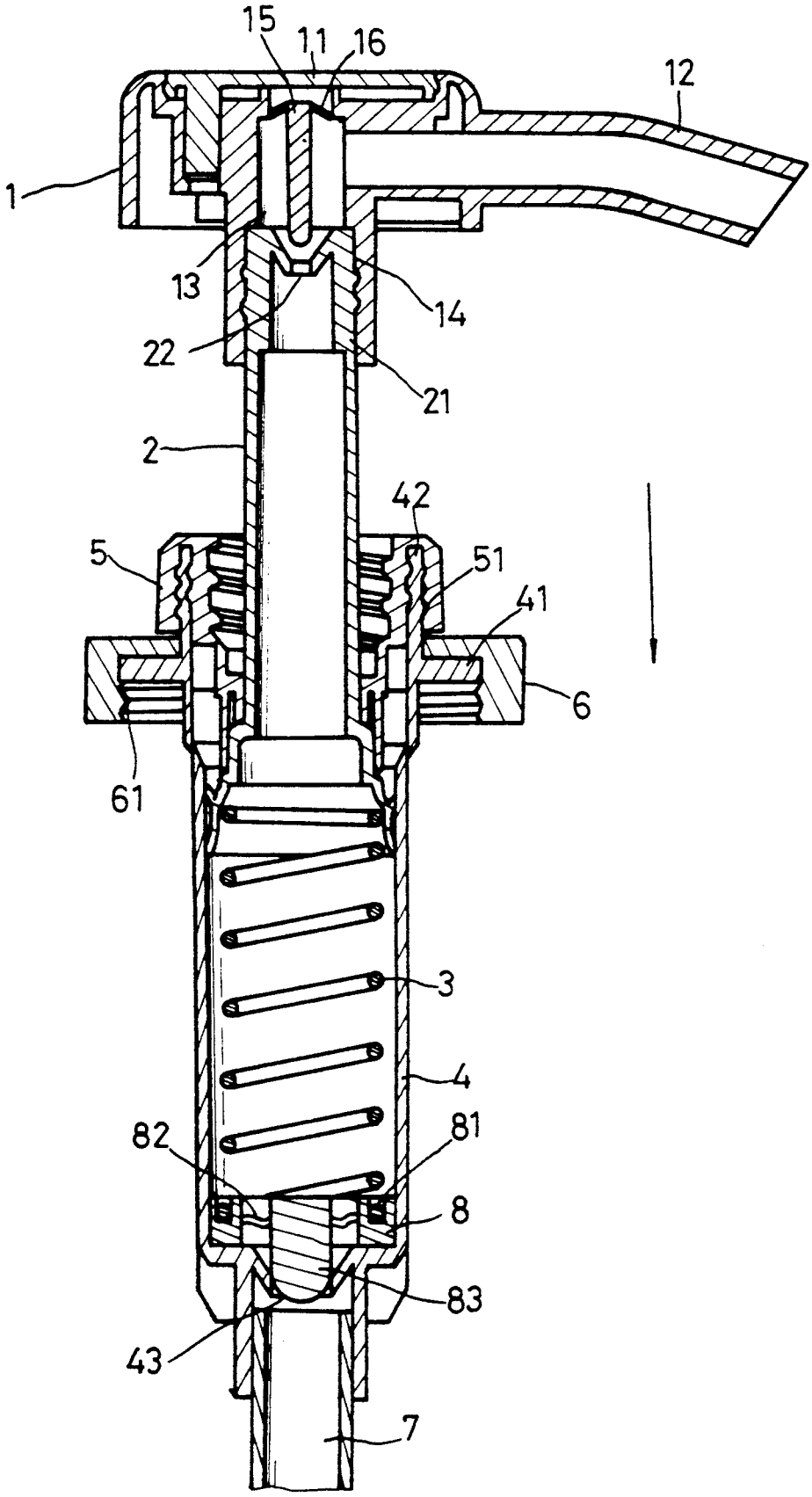
Figures 2, 3:
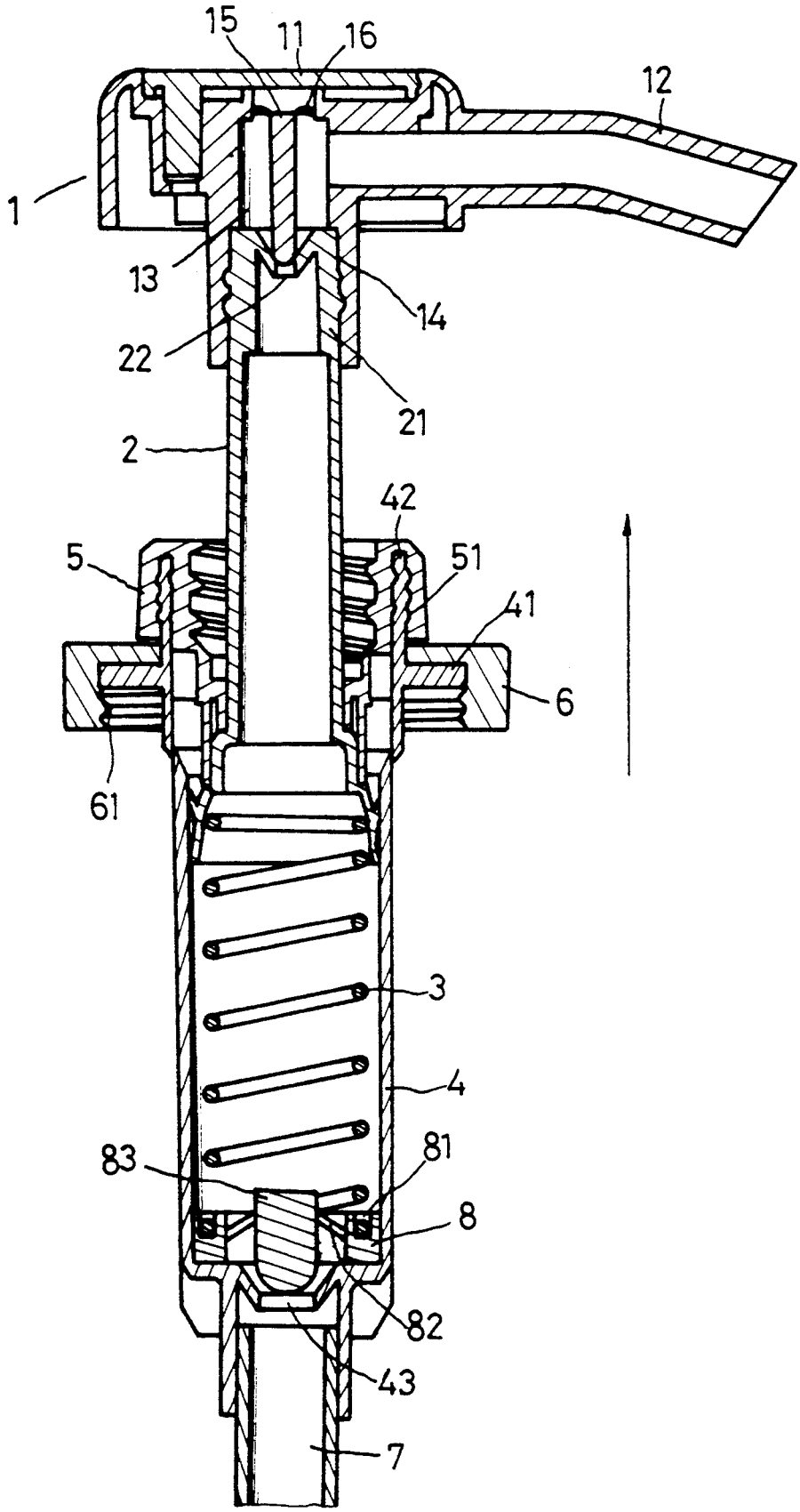

Referring to FIG. 2, the embodiment according to the present invention comprises a nozzle head 1, a piston 2, a spring 3, a liquid accumulator 4, a fastening ring 5 and a container cap 6. The nozzle head 1 is substantially a compressing member, which includes a pressing cap 11 with a nozzle tube 12; the nozzle tube 12 is in communication with the nozzle head 1 and a pipe 13. The lower part of the pipe 13 has a click fastening part 14. The piston 2 is a hollow cylinder, while the upper part thereof has a click fastening part 21 to be mated with the click fastening part 14. The spring 3 is mounted under the lower end of the piston 2, and then both the spring 3 and the piston 2 are mounted in the liquid accumulator 4. The upper end of the liquid accumulator 4 has a flange 41, on which the container cap 6 is fastened; the upper end of the liquid accumulator 4 also has a click fastening part 42 to be mated with a click fastening part 51 of the fastening ring 5 so as to have the container cap 6 fastened between the fastening ring 5 and the flange 41. The lower end of the liquid accumulator 4 is fastened with a delivery tube 7. The container cap 6 is fastened to the upper part of the container (not shown) by means of inner threads 61; the delivery tube 7 extends into a liquid in the container; the aforesaid structure is almost the same as that of a conventional pumping head, and therefore no further details are given. The feature of the present invention is that a valve annulus 8 is used for replacing the ball valve in a conventional pump; the valve annulus 8 is made of plastic material, and it has a suitable elasticity. The top edge of the valve annulus 8 has a round groove 81 for receiving the lower end of the spring 3, whereby the valve disk 8 can be fixedly mounted on the inlet 43 on the bottom of the liquid accumulator 4. The central part of the valve disk 8 has a plunger valve 83, being connected in place by means of a spring piece 82. Since the spring piece 82 is made of an elastic material, and has a given elasticity so as to enable the plunger valve 83 to move downwards to close the inlet 43. As soon as the pressing cap 11 of the nozzle head 1 is pushed downward, the piston 2 will push the spring downwards so as to accumulate a given amount of dynamic force. As soon as the pressure to the nozzle head 1 is released, the spring 3 will push the piston 2 upward, and the liquid accumulator 4 will generate a suction force to draw a liquid in the container into the liquid accumulator 4 through the delivery tube 7; at the same time, the plunger valve 83 of the valve annulus 8 will also be drawn upward (as shown in FIG. 3-2) to have the inlet 43 opened so as to let the liquid flow through; when the liquid is drawn into the liquid accumulator 4, and the piston returns to its normal position, the suction force to the valve annulus 8 will be removed; then, the plunger valve 83 will move downwards as a result of its elasticity to close the inlet 43 closely without having the drawback of the conventional ball-valve type of pump, in which the inlet is to be closed by the gravity force of a ball, and such a valve is susceptible to infiltration leakage because of the ball being often coated with liquid; according to the present invention, the plunger valve 83 can tightly close the inlet under non-pumping condition.

Figure 1:
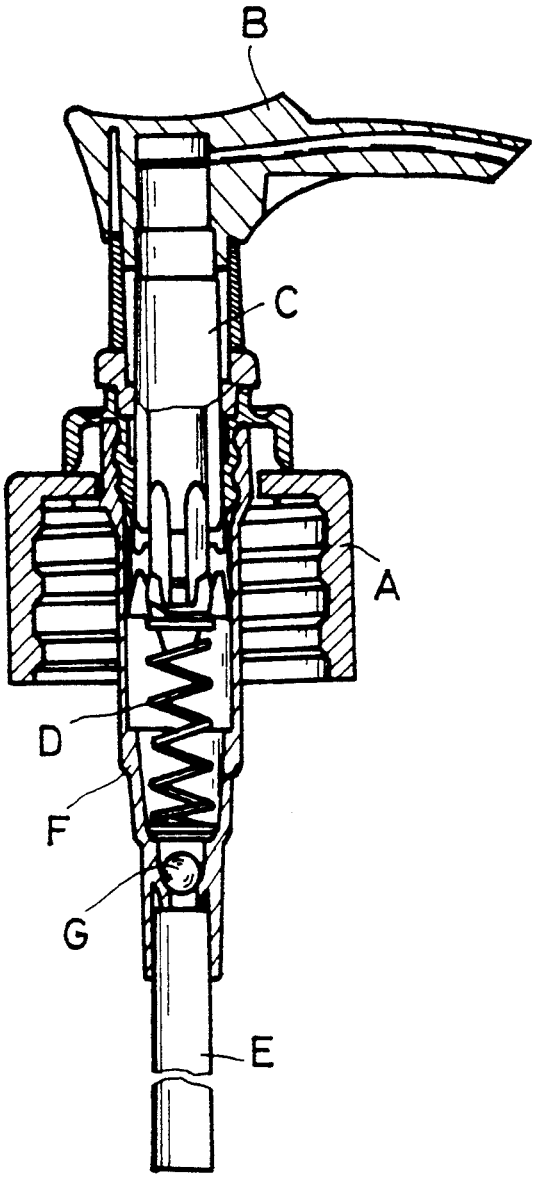
FIG. 1 (PRIOR ART)
FIG. 1 is a sectional view of a conventional pump structure.

Moreover, an upper plunger valve 15 is mounted in the pipe 13 of the nozzle head 1, and is molded integrally with the nozzle tube 12; the upper plunger valve 15 is to be mated with an outlet 22 on the upper end of the piston 2. The upper plunger valve 15 is made of a plastic and elastic material, and it has a spring piece 16, being fastened in the nozzle head 1; the upper plunger valve 15 can tightly close the outlet 22 because of its elasticity so as to prevent the liquid in the liquid accumulator from flowing down upon the pump being set upside-down. As a result of the spring piece 16 having elasticity, the upper plunger valve 15 will move upwards to have the outlet 22 opened (as shown in FIG. 3-1) upon the liquid being pumped so as to let the liquid flow through the outlet 22.

I claim:

1. A pumping-head structure comprising a nozzle head, a piston, a first spring member, a liquid accumulator, a delivery tube, a fastening ring and a container cap;

said nozzle head comprising a nozzle tube, an axial portion, an outlet and a pipe, said pipe being in said axial portion of said nozzle head, and said pipe being in communication with said nozzle tube; said pipe having a lower end which is fastened to said piston;

said piston having a lower end and said first spring member having a lower and an upper end, said upper end of said first spring member being attached to said lower end of said piston; and said first spring member and said piston being mounted in said liquid accumulator;

said liquid accumulator having a flange for mounting a container cap; said container cap is fastened in place by a fastening ring by which said container cap is fastened in a position between said fastening ring and said flange;

said liquid accumulator having a lower end and said delivery tube being fastened to said lower end of said liquid accumulator, and said lower end of said liquid accumulator having an inlet;

said pumping-head structure being characterized in that said inlet at said lower end of said liquid accumulator is installed with a valve annulus, said valve annulus having a top and a center, wherein said top of said valve annulus has a round groove for engaging with said lower end of said first spring member so as to fix said valve annulus in place; said center of said valve annulus is attached with a plunger valve via a second spring member, said second spring member exerts a downward force on said plunger valve and thus maintains said inlet tightly closed under normal conditions by a downward action of said plunger valve against said inlet.

2. A pumping-head structure as claimed in claim 1, wherein said nozzle head contains an upper plunger valve connected to said nozzle head by a third spring member; said third spring member exerts an upward force on said upper plunger valve to keep said outlet of said nozzle head in a normally closed position.

3. A pumping-head structure as claimed in claim 1, wherein said valve annulus is made of a plastic material with elasticity.

4. A pumping-head structure as claimed in claim 1, wherein said upper plunger valve and said spring piece are made of a plastic material with elasticity.

* * * * *